US007490468B2

(12) United States Patent
Cooper et al.

(10) Patent No.: US 7,490,468 B2
(45) Date of Patent: Feb. 17, 2009

(54) OPERATION OF AN ENGINE

(75) Inventors: James Edward Cooper, Leicestershire (GB); George McChesney Francis, Coventry (GB); John Andrew Parsons, Nottinghamshire (GB); Nicola Jane Ranzetta, Leicestershire (GB)

(73) Assignee: Microgen Enery Limited, Reading, Berkshire (GB)

( * ) Notice: Subject to any disclaimer, the term of this patent is extended or adjusted under 35 U.S.C. 154(b) by 96 days.

(21) Appl. No.: 10/575,693

(22) PCT Filed: Oct. 13, 2004

(86) PCT No.: PCT/GB2004/004355

§ 371 (c)(1),
(2), (4) Date: Apr. 13, 2006

(87) PCT Pub. No.: WO2005/040588

PCT Pub. Date: May 6, 2005

(65) Prior Publication Data

US 2007/0017221 A1 Jan. 25, 2007

(30) Foreign Application Priority Data

Oct. 13, 2003 (GB) ..... 0323982.9

(51) Int. Cl.
*F01B 29/10* (2006.01)

(52) U.S. Cl. ..... 60/517; 60/521

(58) Field of Classification Search ..... 60/517, 60/521, 522, 525

See application file for complete search history.

(56) References Cited

U.S. PATENT DOCUMENTS

| | | | | | |
|---|---|---|---|---|---|
| 3,303,348 | A | | 2/1967 | Cox et al. | 290/40 |
| 3,660,583 | A | * | 5/1972 | Takanasi et al. | 373/104 |
| 4,601,172 | A | * | 7/1986 | Stotts | 60/521 |
| 4,873,826 | A | | 10/1989 | Dhar | 60/641.14 |
| 4,885,653 | A | * | 12/1989 | Kato | 360/133 |
| 4,891,569 | A | * | 1/1990 | Light | 323/210 |
| 5,203,170 | A | | 4/1993 | Naito | 60/524 |

(Continued)

FOREIGN PATENT DOCUMENTS

EP 0297718 1/1989

(Continued)

OTHER PUBLICATIONS

European Office Action dated Oct. 31, 2007.

*Primary Examiner*—Hoang M Nguyen
(74) *Attorney, Agent, or Firm*—Ballard Spahr Andrews & Ingersoll, LLP

(57) ABSTRACT

This invention relates to a method of operating an engine and, particularly to a method of determining the pressure of a working gas within a Stirling engine of a domestic combined heat and power unit relative to a pre-defined pressure. The present invention provides a method of determining the pressure of a gas within an engine relative to a pre-defined pressure of the gas, comprising measuring the power factor of electricity generated by the engine, comparing the measured power factor with a power factor determined to correspond to the power factor of electricity generated by the engine when operating at the pre-defined pressure and determining whether the measured power factor is less than the determined power factor. Variations in measured power factors may also be used to indicate faults in the engine.

17 Claims, 3 Drawing Sheets

U.S. PATENT DOCUMENTS

| | | | | |
|---|---|---|---|---|
| 5,442,271 | A * | 8/1995 | Hatanaka et al. | 318/729 |
| 6,282,895 | B1 | 9/2001 | Johansson et al. | 60/524 |
| 2002/0002826 | A1 | 1/2002 | Fahringer et al. | 60/602 |

FOREIGN PATENT DOCUMENTS

| | | |
|---|---|---|
| EP | 1689995 | 8/2006 |
| JP | 119490 | 8/1989 |
| WO | WO 2005/040588 | 5/2005 |

* cited by examiner

OPERATION OF AN ENGINE

CROSS REFERENCE TO RELATED APPLICATIONS

The present application claims priority to Great Britain Patent Application No. 0323982.9, filed 13 Oct. 2003, which application is incorporated herein fully by this reference.

1. Technical Field

This invention relates to a method of operating an engine and, in particular although not exclusively, to a method of determining the pressure of a working gas within an engine relative to a pre-defined pressure. The present invention enjoys particular application to use in Stirling engines that may be used in a domestic combined heat and power unit, although the invention has application in many other fields.

2. Background of the Invention

Many types of engines, including the well-known Stirling engine, contain a fixed charge of gas as their working gas. Over time this gas can leak, leading to incorrect operation of an engine. Some means of detecting this leakage is desirable so that the engine can be stopped before the pressure becomes low enough for the engine to operate incorrectly.

Conventional techniques use a pressure sensor to measure the pressure of the working gas directly. Such a pressure sensor is an expensive additional component to incorporate in the design of the engine. Furthermore, connecting a pressure sensor introduces a risk of creating additional leakage paths that increase the leakage rate, thereby exacerbating the problem that the pressure sensor is intended to alleviate. Alternatively, a pressure tapping can be added to the engine so that a service engineer can measure the pressure during visits. Although less expensive, this suffers from a major disadvantage in that it does not offer protection for the engine between visits and still introduces a further connection point that creates a greater potential for leakage.

A further issue is that the design of the engine is such that the anticipated leakage rate of the majority of engines is at an acceptable level and so they will not fail through leakage. However, some engines may have higher leakage rates due to manufacturing defects such as poor welds. It follows that a requirement to include dedicated pressure measuring devices to monitor the pressure in every engine in order to identify the small number of faulty units could result in a disproportionate cost burden.

SUMMARY OF THE INVENTION

Against this background, and from a first aspect, the present invention resides in a method of determining the pressure of a gas within an engine relative to a pre-defined pressure of the gas comprising the steps of: (a) measuring the power factor of electricity generated by the engine; (b) comparing the measured power factor with a power factor determined to correspond to the power factor of electricity generated by the engine when operating at the pre-defined pressure; and (c) determining whether the measured power factor is less than the determined power factor.

The term 'power factor' is well understood within the art, but the following is offered by way of explanation to those not familiar with this term. Apparent power is a measure of alternating current (AC) that is calculated by multiplying current by voltage. In a direct current (DC) circuit, or an AC circuit whose impedance is a pure resistance, the voltage and current will be in phase and the formula P=EI holds where P is the power in Watts, E is the voltage in Volts and I is the current in Amperes.

However, in an AC circuit whose impedance consists of reactance as well as resistance, there is a phase difference between voltage and current. This phase displacement introduces an additional element to consider when determining system power, namely the power factor.

When the impedance of an AC circuit is a pure resistance, the phase difference ($\theta$) between voltage and current is zero and the apparent power is the same as the true power (the actual power delivered to and consumed by the load). The power factor is defined to be the ratio between the apparent power and the true power and they are equal in a purely resistive AC circuit such that the power factor is unity. However, when reactance exists, the phase difference between current and voltage causes the apparent power to be greater than the real power. In this case, the true power is determined by $P_R$=EI cos $\theta$ where cos $\theta$ represents the power factor.

The power factor is an intrinsic property of an engine that is conveniently monitored as part of the normal control of that engine. It has been found that the use of this value is a reliable indicator of engine pressure that requires no additional sensors and so can be implemented at little additional cost. Furthermore, avoiding the need to install a dedicated pressure sensor also avoids introducing additional leakage paths.

The present invention also extends to a method of operating an engine containing a working gas, comprising the steps of: (a) measuring repeatedly the power factor of electricity generated by the engine when running; (b) comparing measured power factors to a pre-defined power factor determined to correspond to the power factor of electricity generated by the engine when operating such that the working gas within the engine is at a pre-defined pressure; and (c) producing an alarm when the measured power factor is less than the determined power factor.

The alarm may alert a user to the fact that the engine requires attention, possibly requiring a service or possibly that the engine should be shut down. This method may be used when operating a Stirling engine, for example installed in a domestic combined heat and power unit.

Optionally, the engine is connectable to an electrical grid and step (b) of the method comprises comparing power factors measured when the engine was isolated from the electrical grid.

Local power factor values on the grid can vary owing to the changing loads on the supply. The variation in power factor means that acquiring an absolute value of the engine's power factor can be problematic. In order to avoid these problems, it is proposed that the engine power factor is monitored during the start-up routine when the engine is not connected to the grid.

Preferably, step (b) comprises comparing the measured power factor with a pair of determined power factors and step (c) comprises producing an alarm if a measured power factor is found to be less than the higher of the determined power factors and shutting down the engine if a measured power factor is found to be less than the lower of the determined power factors. Such an arrangement allows attention to be drawn to the fact that operation of the engine is deteriorating that may ultimately lead to the engine being shut down. Hence, prior warning is given of an imminent engine shut down.

Preferably, the power factor is determined empirically, although other methods may be employed.

The information provided by repeatedly measuring power factors over a period of time may also be used in diagnostics by looking for variations across the values. Hence, from a second aspect, the present invention resides in a method of operating an engine containing a working gas comprising the steps of: (a) measuring repeatedly the power factor of electricity generated by the engine when running; (b) storing the measured power factors; (c) analysing at least some of the stored power factors to identify any variation across the power factors; and (d) producing an alarm when a variation beyond an acceptable limit is identified.

The power factor values may be measured continuously, periodically or from time to time, as preferred. The power factors may be stored in a memory or the like, for later retrieval and analysis. The stored power factors may be analysed as desired. For example, the stored power factors may be analysed each time a new power factor is measured or may be analysed at pre-determined intervals. Variations may be determined by any number of standard mathematical techniques. Generally, whichever technique is chosen, a measure of deviation will be provided that may be compared to a threshold that represents an acceptable limit. If the deviation exceeds the acceptable limit, an alarm may be produced to draw attention to the fact that the engine has a fault. Optionally, the engine may be shut down if the acceptable limit is exceeded.

According to a more sophisticated embodiment, a distinction is made between gradual variations and abrupt variations. Then an alarm may be provided when a gradual variation is identified, and an alarm may be provided along with shutting down the engine when an abrupt variation is identified. Various methods may be used to distinguish between gradual and abrupt variations. For example, abrupt variations may be identified merely be comparing a stored power factor with the immediately preceding power factor or an average of the immediately preceding power factors. Gradual variations may be identified by examining trends in many successive power factors. Abrupt variations may be measured against any gradual variation, e.g. if a power factor value exceeds a value projected in accordance with the foregoing gradual variation. Of course, acceptable limits may be set separately for the gradual and abrupt variation.

From a third aspect, the present invention resides in an engine unit comprising an engine containing a working gas; a power monitor operable to produce a power factor signal representative of the power factor of electricity generated by the engine; control means configured to receive the power factor signal; and an alarm; wherein the control means is operable to use the power factor signal to determine whether the power factor of the engine is less than a pre-determined power factor that corresponds to the power factor of electricity generated by the engine running with the working gas at a pre-defined pressure and to operate the alarm if the power factor is determined to be less than the pre-determined power factor.

From a fourth aspect, the present invention resides in an engine unit comprising: an engine containing a working gas; a power monitor operable to produce a power factor signal representative of the power factor of electricity generated by the engine; control means configured to receive the power factor signal; and an alarm; wherein the control means is operable: to store the measured power factors; to compare at least some of the stored power factors to identify any variation across the power factors; and to produce an alarm when a variation beyond an acceptable limit is identified.

The control means of the present invention according to the third or fourth aspect may be embodied in either a hardware or software form. For example, the control means may comprise an electronic circuit that operates as a comparator or it may be a suitably programmed computer processor.

According to a further aspect, the present invention resides in a computer when programmed to perform the following steps: to receive from a power monitor a power factor signal representative of a power factor of electricity generated by an engine containing a working gas; to use the power factor signal to determine whether the power factor of the engine is less than a pre-determined power factor value stored in memory that corresponds to the power factor of electricity generated by the engine running with the working gas at a pre-defined pressure; and to create an alarm if the power factor is determined to be less than the pre-determined power factor.

The present invention also resides in a computer when programmed to perform the following steps: to receive repeatedly from a power monitor a power factor signal representative of a power factor of electricity generated by an engine containing a working gas; to store the measured power factors in a memory; to analyse at least some of the stored power factors to identify any variation across the power factors; to compare any variation found with an acceptable limit stored in a memory; and to create an alarm when the compared variation is found to exceed the acceptable limit.

According to a still further aspect, the present invention resides in a computer program comprising computer program instructions that, when loaded into a computer, cause it to operate as described above and in a computer program product comprising a recordable medium having recorded thereon such a computer program.

BRIEF DESCRIPTION OF THE DRAWINGS

In order that the invention can be more readily understood, reference will now be made, by way of example only, to the accompanying drawings in which.

DETAILED DESCRIPTION OF A PREFERRED EMBODIMENT

The present invention finds useful application in a Stirling engine, although it may be used with many types of engine. One specific but not limiting application is in the operation of a Stirling engine 10 within a dchp unit 12 like the one shown in FIG. 1. The Stirling engine 10 in this embodiment contains helium as a working gas. It has been observed that a reduction in helium pressure brings about a reduction in the power factor of electricity generated by the engine 10. This is because a reduced helium pressure lowers the natural frequency of the Stirling engine 10 and subsequently produces a higher phase difference between voltage and current.

It is currently thought that this may be explained by considering the following relationships.

Pressure vs frequency—as the helium pressure varies, the gas spring forces between the reciprocating internal components varies. A great deal of theoretical work has been carried out by many parties, over many years, to understand and define this relationship, but it is a complex interaction between the thermodynamic and mechanical variables involved. To give a simplified version, higher pressures give greater gas spring forces on the reciprocating components, which give a predictable increase in the resonant frequency of the system.

Power factor vs frequency—apparent power is made up of the true power (dissipated through the resistances within the alternator and connected circuitry), and the reactive power (representing the power alternately given to and received from the inductances within the circuitry). The reactive power increases with the frequency of the signal, which is also the frequency of reciprocation of the system. Thus the apparent power, and therefore the power factor, varies with operating frequency. As the power factor is a ratio between apparent and true powers it can be assumed to be independent of the actual power output.

Pressure vs power factor—by combining the relationships above, the power factor increases with the pressure of the system.

Figure 1:
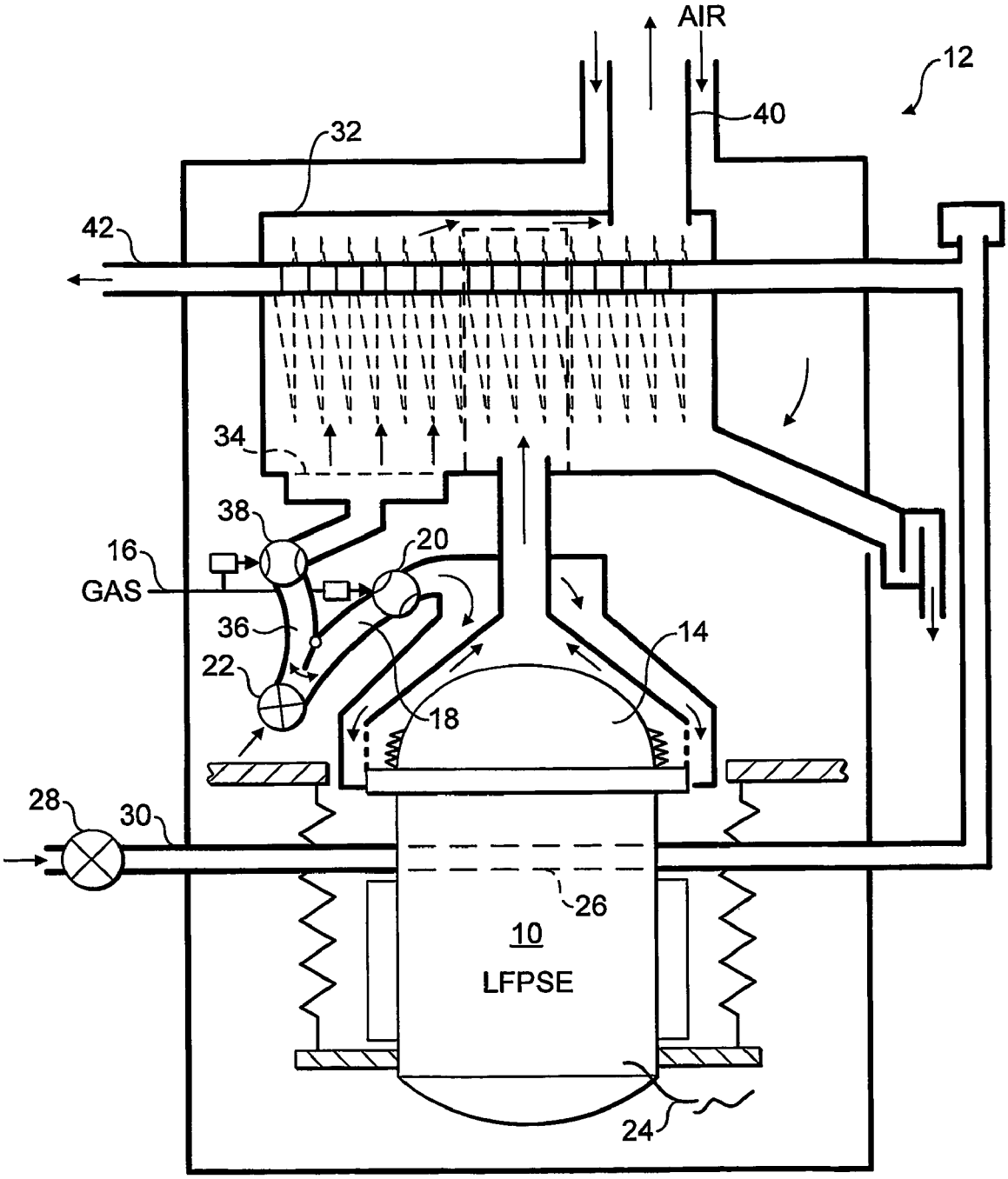
FIG. 1 is a schematic view of a domestic combined heat and power unit (dchp) unit including a Stirling engine.

The dchp unit 12 is based around a Stirling engine 10 as shown in FIG. 1. The engine is preferably a linear free-piston Stirling engine 10, the operation of which is well known in the art.

The Stirling engine 10 is driven by a heat input from an engine burner 14. This burner 14 is fuelled by a combustible gas supply 16 that is mixed with an air supply 18 under the control of a valve 20. The mixed stream is fed to the burner 14 by a fan 22. This drives the Stirling engine 10 to generate an electrical output 24 from a linear alternator. The alternator is not shown in FIG. 1, but may be located within the pressure vessel enclosing the engine or it may be located externally and coupled to the engine 10 via a drive shaft. Heat is extracted from the Stirling engine 10 at a cooler 26 that is essentially a heat exchanger through which water is pumped by a pump 28 along line 30. The water passing through the cooler 26 is then further heated in a heat exchanger 32 by exhaust gas from the engine burner 14 that has heated the head of the Stirling engine 10. In order to provide further heating of the water, and also to provide a degree of independence to heat the water when the Stirling engine 10 is not being operated, a supplementary burner 34 is provided to heat the water in the heat exchanger 32. The supplementary burner 34 is fuelled by the combustible gas supply 16 which is mixed with an air supply 36 under the control of a valve 38. The mixed stream is fed to the supplementary burner 34 by the fan 22.

The fan 22 feeds air to mixer valves 20 and 38 through a diverter valve (not shown) that ensures the correct air flow to each mixer.

In an alternative design, separate fans have been used to feed air to the two gas/air mixer valves 20,38. This removes the need for a diverter valve but, as described in our co-pending Application GB0130380.9, it does carry significant weight, cost and efficiency penalties over the single fan design.

Exhaust gases from the engine burner 14 and supplementary burner 34 which have given up their heat in the heat exchanger 32 then exit along flue 40. In this manner, the Stirling engine 10 produces an electrical output 24 and a heat output 42 which may be used, for example, to provide the domestic hot water requirement, to feed a central heating system, or both of these in a combination arrangement ("combi" boiler).

Figure 2:
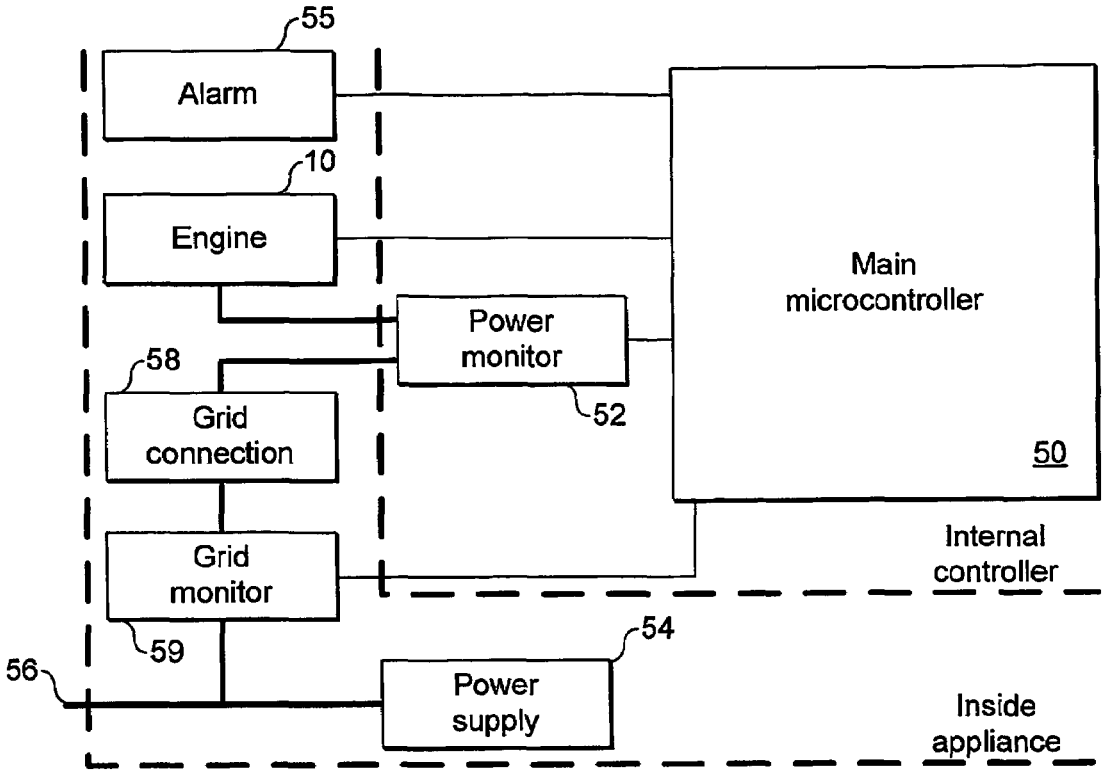
FIG. 2 is a schematic diagram of the Stirling engine of FIG. 1, its controller and its connection to an electrical grid.

The proposed dchp unit 12 is designed to provide up to 1 kW of electricity (net) feeding directly into the domestic network and, hence, combining with the supply from the grid. The connection of the dchp unit 12 to the grid is shown in FIG. 2.

As can be seen, the dchp unit 12 is controlled by a main micro-controller 50 that has connections to the Stirling engine 10, to a power monitor 52, to its own power supply 54 and to an alarm 55. The micro-controller's power supply 54 is fed from the grid 56. The power monitor's function is to monitor the output of the Stirling engine 10 and to measure the power factor of the electricity produced by the linear alternator during operation, as is described in more detail below. The power monitor 52 is connected to the grid 56 and by a grid connection module 58 that is, in turn, connected to a grid monitor 59 that monitors the grid's voltage and frequency. The grid monitor 59 signals the grid connection module 58 to disconnect from the grid 56 when the supply is outside preset limits.

The power monitor 54 derives the value for the power factor of electricity generated by the Stirling engine 10 (via the linear alternator) at any instant in time using a standard power meter of the type commonly available. For example, the power factor could in practice be deduced by control circuitry on the power monitor 54 or main micro-controller 50 by using the measured V and I signals from the alternator. The apparent power is calculated from P=VI. A timing circuit may be used to measure the time difference between the V and I waveforms, giving the phase difference. The true power is then VI cos θ and the power factor is true power/apparent power.

The value of the power factor supplied by the power monitor 54 can be compared against a relationship that relates the power factor with the pressure of the helium within the Stirling engine 10. This relationship is preferably obtained empirically and it can be obtained for each and every engine 10 or it can be derived for one engine 10 and applied to like engines (e.g. all engines 10 of the same type or all engines 10 produced in a single manufacturing run). An example of such a relationship is shown in FIG. 3.

Figure 3:
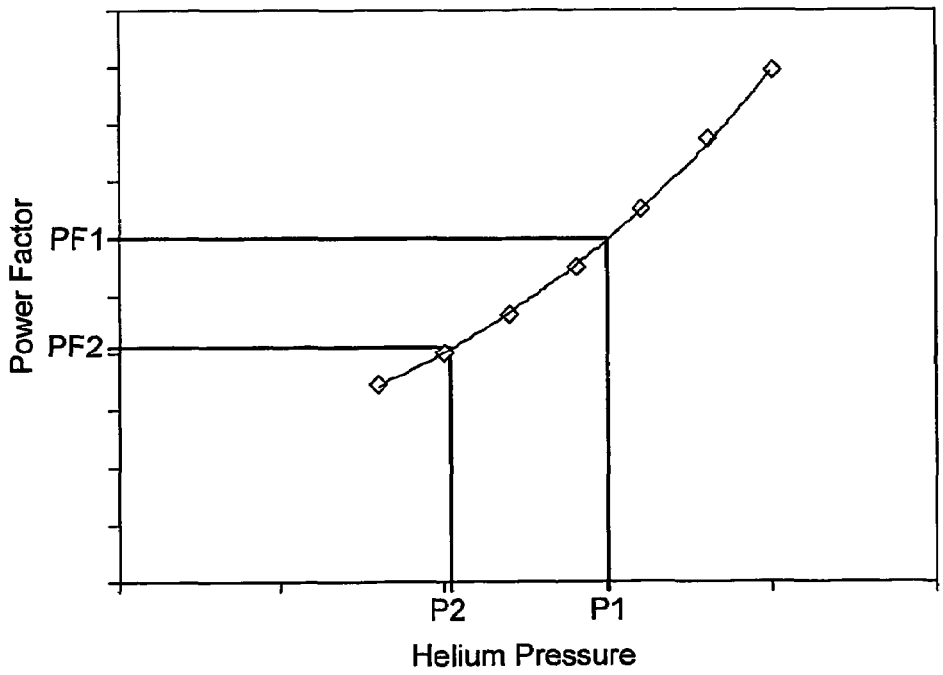
FIG. 3 is a graph showing the relationship between the power factor associated with a Stirling engine versus the helium pressure within the Stirling engine.

As can be seen from FIG. 3, power factor is proportional to helium pressure although not linearly. Comparison of the measured power factor of the Stirling engine 10 to the appropriate relationship such as that shown in FIG. 3 yields the helium pressure within the Stirling engine 10.

Figure 4:
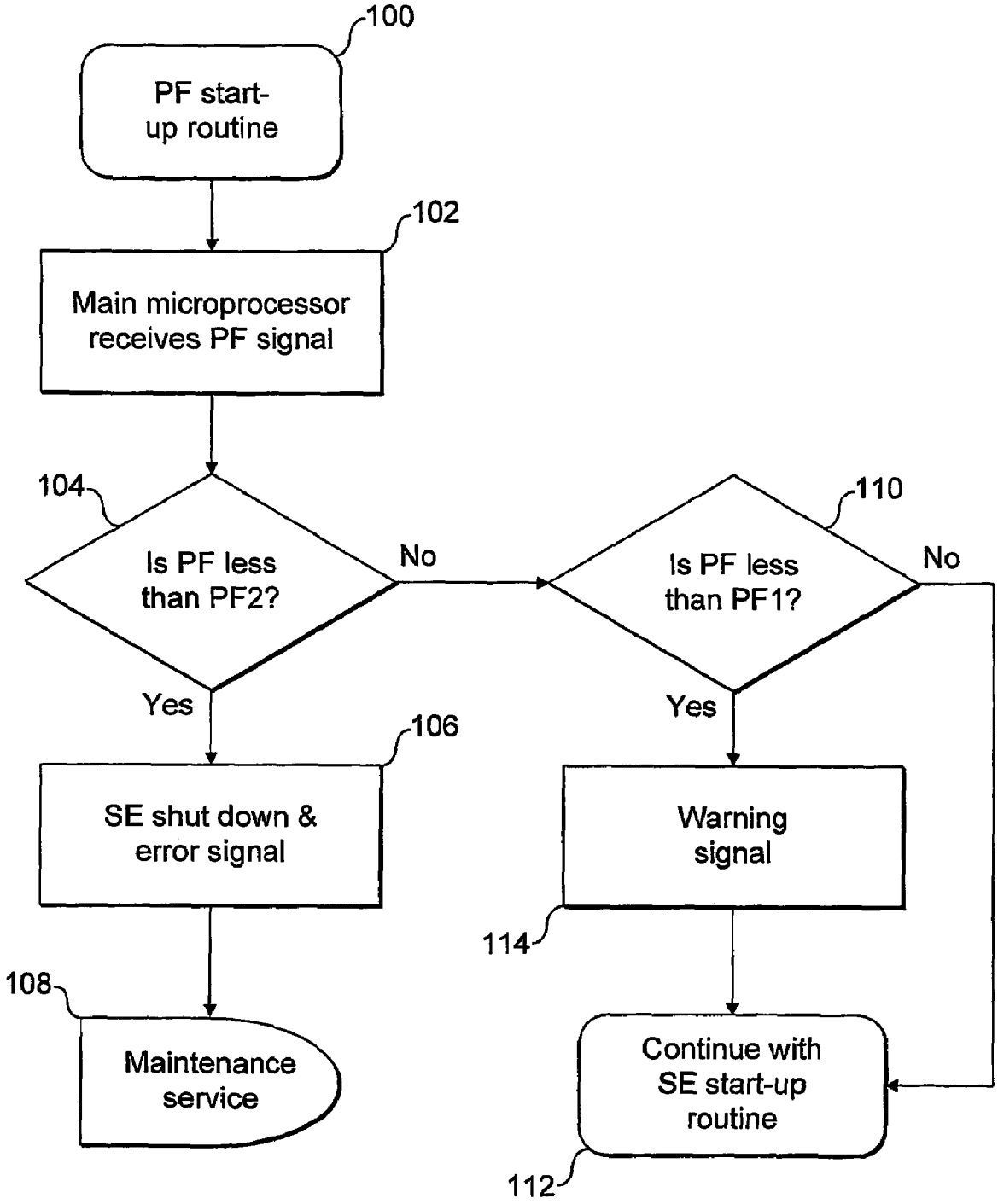
FIG. 4 is a flow chart summarising the start up routine of a dchp unit operated in accordance with the method of the present invention.

Measuring the power factor associated with the Stirling engine 10 when connected to the grid 56 is problematic as the local power factor values on the grid 56 itself can vary over a wide range owing to the changing loads seen by the grid 56. This variation in grid power factor means that acquiring the absolute value of the power factor associated with the Stirling engine 10 can be problematic. In order to avoid these problems, the power factor of the Stirling engine 10 is monitored prior to connection to the grid 56. This is performed as part of the start-up routine of the dchp unit 12 during the transition between motoring and full grid connection at 58. This is shown at the top of FIG. 4 at 100.

During the start-up routine 100, the power monitor 52 periodically measures the power factor of a Stirling engine 10 by measuring the electricity produced by the linear alternator. The power-factor signal provided by the power monitor 52 is received and processed by the main micro-controller 50 as shown at 102 by performing a comparison to the relationship of power factor (PF) and helium pressure (P) in any number of standard ways.

In particular, the determined helium pressure (P) is monitored to ensure that it does not fall below a threshold value (P1, P2) that will result in inefficient operation of the Stirling engine (10). This may be done by direct or indirect comparison with an associated power-factor value (PF1, PF2) that corresponds to the Stirling engine 10 operating at the threshold helium pressure (P1, P2).

In fact, two threshold values are used rather than just one, as shown in FIG. 3. The first threshold pressure (P1) corresponds to safe but inefficient operation of the Stirling engine and the second threshold pressure (P2) corresponds to a regime where the Stirling engine 10 is operating at unacceptable levels of performance.

A pressure determined to be greater than P1 represents the acceptable operating range of the helium pressure within the Stirling engine 10. Such a returned value does not cause the micro-controller 50 to intervene in the operation of the engine 10.

A returned value between P2 and P1 corresponds to a pressure that, while safe for operation, is deemed not to produce acceptable levels of performance from the Stirling engine 10. Consequently, the main micro-controller 50 displays a warning signal on the alarm 55, such as a warning light or an audible alarm, to inform the user that the dchp unit 12 requires a service.

If the returned helium pressure is less than P2, the main micro-controller 50 shuts down the Stirling engine 10 and displays a different warning signal on the alarm 55.

This method of operation is summarised in FIG. 4, where it is implemented as a two-stage comparison. Specifically, the measured power factor is first compared with PF2 at 104: if less than PF2, the dchp unit 12 is shut down at 106, and a maintenance service performed subsequently at 108; otherwise, it is compared with PF1 at 110. If greater than PF1, start up of the dchp unit 12 continues as normal at 112 but, if less than PF1 but greater than PF2, start up of the dchp unit 12 at 112 is accompanied by display of the warning signal on the alarm 55 as shown at 114.

The skilled person will appreciate that the above embodiment can be varied without departing from the scope of the present invention.

For example, the present invention has application to Stirling engines 10 in any environment and is not restricted purely to their use within a dchp unit 12. For example, Stirling engines 10 are used in refrigerators, heat pumps, cyro-coolers and in auxiliary power systems. In addition, the present invention is not restricted to use only in Stirling engines 10, but may be used in working engines that contain a gas where a measure of the gas pressure is desired.

Whilst the relationship of FIG. 3 was found empirically in the above embodiment, the relationship can be obtained in any number of ways. For example, it may be obtained through calculations or computer modelling. Where a full relationship is found, it may be expressed mathematically by using a curve fitting routine for example. That said a full relationship need not be found. For example, merely one or more threshold power factor values (PF1, PF2) can be used with a direct comparison made only to these values (PF1 and PF2).

The number of threshold values (P1, P2, PF1, PF2) and the response thereto can be varied according to preference. For example, only one threshold value may be used which may result in automatic shutdown of the engine 10 and a warning signal being displayed 114. Alternatively, more than two threshold values (P1, P2, PF1, PF2) may be used such that a graduated series of alarms is used to warn the user prior to eventual shutdown of the engine 10 at 106. This could be used, for example, with colour-coded warning lights that change colour from green to red.

The actual embodiment of the warning signal 114 can be readily adapted to suit needs. Any signal that draws attention to the dchp unit 12 would be suitable and these could be visual, auditory or could make use of any other sense.

Whilst the embodiment described above measures the power factor associated with the Stirling engine 10 prior to connection to the grid 56 during a start-up routine, other times are possible. For example, the engine 10 may be temporarily disconnected from the grid 56 for measurements to be taken, or the measurements may be taken prior to shutting down the engine 10. In addition, measurements may even be taken while the engine 10 is connected to the grid 56 although the results will suffer due to the variation in power factors imposed on the Stirling engine 10 due to fluctuations within the grid supply. These functions may be compensated for by using an averaging procedure or the like.

In addition, the power factor may be monitored continuously or periodically to provide improved diagnostics of the Stirling engine 10. For example, the band of expected power factors for the acceptable operating helium pressures are defined and stored as diagnostic information within the control system. This band will vary from the lowest pressure at start-up when cold (less a tolerance band, e.g. 5%) to the highest pressures at maximum operating temperatures (plus a tolerance band, e.g. 5%). V and I signals may be sampled during regular operation of the alternator, and the power factor determination allows any deviation outside the acceptable band to be immediately flagged as a cause for concern, and a service visit is recommended (on-screen display), or scheduled (on-line diagnostics).

Generally, any changes due to helium leakage will manifest itself as a gradual drift from the expected values. This will give a gradual decrease in generating efficiency. Monitoring changes in the power factor may also indicate more serious faults in the Stirling engine 10. For example, if the deviation is more pronounced and sudden, it may indicate a serious engine problem. Engine operation will then be suspended and the appliance will operate with heating only, using the grid power supply when available, until a service visit has been performed. This will pre-empt and therefore avoid damage to internal components which could otherwise result from extended engine operation at pressures below the acceptable design values.

The invention claimed is:

1. A method of determining the pressure of a gas within an engine relative to a pre-defined pressure of the gas, comprising the steps of:

(a) measuring the power factor of electricity generated by the engine;

(b) comparing the measured power factor with a power factor determined to correspond to the power factor of electricity generated by the engine when operating at the pre-defined pressure; and (c) determining whether the measured power factor is less than the determined power factor, to thereby determine the pressure of the gas relative to a pre-defined pressure.

2. A method of operating an engine containing a working gas comprising the steps of:

(a) measuring repeatedly the power factor of electricity generated by the engine when running;

(b) comparing measured power factors to a pre-defined power factor determined to correspond to the power factor of electricity generated by the engine when operating such that the working gas within the engine is at a pre-defined pressure; and (c) producing an alarm when a measured power factor is found to be less than the determined power factor.

3. A method of operating an engine according to claim 2, wherein the engine is a Stirling engine.

4. A method of operating an according to claim 3, wherein the engine forms part of a domestic combined heat and power unit.

5. A method according to claim 2 wherein the engine is connectable to an electrical grid and step (b) of the method comprises comparing power factors measured when the engine was isolated from the electrical grid.

6. A method according to claim 5, wherein step (b) of the method comprises comparing power factors measured during start-up of the engine.

7. A method according to claim 2, wherein step (b) comprises comparing the measured power factor with a pair of determined power factors and step (c) comprises producing an alarm if a measured power factor is found to be less than the higher of the determined power factors and shutting down the engine if a measured power factor is found to be less than the lower of the determined power factors.

8. A method according to claim 2, wherein the determined power factor or factors is/are determined empirically.

9. A method of operating an engine containing a working gas comprising the steps of:

(a) measuring repeatedly the power factor of electricity generated by the engine when running;

(b) storing the measured power factors;

(c) analysing at least some of the stored power factors to identify any variation across the power factors; and (d) producing an alarm when a variation beyond an acceptable limit is identified.

10. The method of claim 9, further comprising shutting down the engine when the variation is beyond the acceptable limit.

11. The method of claim 9, further comprising distinguishing between a gradual variation and an abrupt variation, and providing an alarm when a gradual variation is identified and providing an alarm and shutting down the engine when an abrupt variation is identified.

12. An engine unit comprising:

an engine containing a working gas;

a power monitor operable to produce a power factor signal representative of the power factor of electricity generated by the engine;

control means configured to receive the power factor signal; and an alarm;

wherein the control means is operable:

to use the power factor signal to determine whether the power factor of the engine is less than a pre-determined power factor that corresponds to the power factor of electricity generated by the engine running with the working gas at a pre-defined pressure; and to operate the alarm if the power factor is determined to be less than the pre-determined power factor.

13. An engine unit comprising:

an engine containing a working gas;

a power monitor operable to produce a power factor signal representative of the power factor of electricity generated by the engine;

control means configured to receive the power factor signal; and an alarm;

wherein the control means is operable:

to store the measured power factors;

to analyse at least some of the stored power factors to identify any variation across the power factors; and to produce an alarm when a variation beyond an acceptable limit is identified.

14. A processor programmed to perform the following steps:

to receive from a power monitor a power factor signal representative of a power factor of electricity generated by an engine containing a working gas;

to use the power factor signal to determine whether the power factor of the engine is less than a pre-determined power factor value stored in memory that corresponds to the power factor of electricity generated by the engine running with the working gas at a pre-defined pressure; and to create an alarm if the power factor is determined to be less than the pre-determined power factor.

15. A processor programmed to perform the following steps:

to receive repeatedly from a power monitor a power factor signal representative of a power factor of electricity generated by an engine containing a working gas;

to store the measured power factors in a memory;

to analyse at least some of the stored power factors to identify any variation across the power factors;

to compare any variation found with an acceptable limit stored in a memory; and to create an alarm when the compared variation is found to exceed the acceptable limit.

16. A computer-readable medium encoded with a program comprising computer program instructions that, when loaded into a processor, cause it to perform the steps of:

receiving from a power monitor a power factor signal representative of a power factor of electricity generated by an engine containing a working gas;

using the power factor signal to determine whether the power factor of the engine is less than a pre-determined power factor value stored in memory that corresponds to the power factor of electricity generated by the engine running with the working gas at a pre-defined pressure; and creating an alarm if the power factor is determined to be less than the pre-determined power factor.

17. A computer-readable medium encoded with a program comprising computer program instructions that, when loaded into a processor, cause it to perform the steps of:

receiving repeatedly from a power monitor a power factor signal representative of a power factor of electricity generated by an engine containing a working gas;

storing the measured power factors in a memory;

analyzing at least some of the stored power factors to identify any variation across the power factors;

comparing any variation found with an acceptable limit stored in a memory; and creating an alarm when the compared variation is found to exceed the acceptable limit.

* * * * *